United States Patent [19]

Trevithick

[11] 4,010,336

[45] Mar. 1, 1977

[54] HAND LAMP

[75] Inventor: Tony Trevithick, Gurnee, Ill.

[73] Assignee: Daniel Woodhead, Inc., Northbrook, Ill.

[22] Filed: July 10, 1974

[21] Appl. No.: 487,215

[52] U.S. Cl. ..... 200/51 R; 240/54 R; 339/59 L

[51] Int. Cl.² ..... H01R 13/70

[58] Field of Search ..... 200/51 R, 51.16; 339/59 L, 60 R, 14 R, 94 L; 174/51 R; 240/54 A, 54 R

[56] References Cited

UNITED STATES PATENTS

| | | | |
|---|---|---|---|
| 503,349 | 8/1883 | Lee | 339/94 L |
| 1,976,362 | 10/1934 | Nielsen | 240/54 R |
| 1,988,321 | 1/1935 | Kollath et al. | 339/59 L |
| 2,119,146 | 5/1938 | Adams | 200/51.16 |
| 2,215,311 | 9/1940 | Adams | 200/51.16 |
| 2,408,157 | 9/1946 | Adams | 200/51.16 |
| 2,534,875 | 12/1950 | Miller | 200/51.16 |
| 2,774,048 | 12/1956 | Baenziger | 339/59 L |
| 3,159,443 | 12/1964 | Hart | 339/14 |
| 3,359,527 | 12/1967 | Hart | 339/59 L |
| 3,668,602 | 6/1972 | Griffin | 339/59 L |

*Primary Examiner*—David Smith, Jr.
*Attorney, Agent, or Firm*—Johnson Dienner Emrich & Wagner

[57] ABSTRACT

A hand trouble lamp with a one-piece molded hollow body of an impact-resistant elastomer open at both ends, and a rigid socket member insertable into said body through one end thereof. The socket member is made in two halves and may be completely bussed, as necessary, and connected to the conductor of a cord outside of the handle body and then inserted therein. A switch or an outlet receptacle or both may be included on the socket member, and both completely covered by the handle body to make it dust and oil proof.

5 Claims, 12 Drawing Figures

HAND LAMP

BACKGROUND OF THE INVENTION

Hand trouble lamps have been made of a molded material heretofore, but have been made in two halves. The internal socket member had to be connected to the conductors of the cord and wired in place in one of the halves, and then assembled by securing the two halves of the handle together. The complete assembly required time and was a relatively complex procedure. Also, the cord was clamped by a loose clamping structure, as a part of the handle.

Another type of hand lamp heretofore made embodied a one-piece molded rubber handle with elastomeric socket, but connections to the power cord were made by splicing the individual conductors to wires hanging loosely from the socket. When a switch and/or a side outlet were provided it was necessary to provide additional conductors, rendering assembly extremely difficult and time consuming. Furthermore, the switch and outlet receptacle were exposed through openings in the wall of the body member, and, therefore, dust, oil, grease and the like, usually present where such trouble lamps are used would enter such openings and either cause malfunction or require frequent disassembly and cleaning.

The present invention is designed to overcome these disadvantages.

BRIEF SUMMARY OF THE INVENTION

The invention relates to hand lamps, and particularly to trouble lamps, customarily used by mechanics when working around or repairing machines, engines and the like. Such lamps consist of an internal socket assembly wired and connected to the conductors of a cord leading from a source of electrical energy. One end of such socket receives a light bulb, and the assembly has a covering which forms a handle for the user.

The socket assembly may be provided with a light switch or an outlet receptacle in a side thereof, for use with an electrically operated tool or it may have both of these or neither. The present invention is designed to overcome the disadvantages mentioned above and to simplify assembly of the parts, as well as to provide a construction which prevents dust, oil, grease and the like from reaching the socket member within its covering or handle.

The outer covering or body member is molded in one piece, and is hollow with openings at both ends thereof. The socket member is pre-wired and bussed outside of the body member. The cord leading from the source of electrical energy is received through one open end of the body and is clamped securely to one end of the socket member and the conductors therein are connected to the socket member. The completely wired and bussed socket is then inserted into the body member through the other open end thereof and releasably retained therein. Heretofore, the cord had been loosely clamped inside of the body of the handle.

The body member is provided with a flexible button in the wall thereof if the socket member has a switch. Thus, instead of the switch extending through an opening in the wall of the body member through which dirt, oil, etc. may enter, it is completely covered at all times and is actuated by pressing the flexible button.

Likewise, when the socket member is provided with an outlet receptacle, the body member of the present invention has an area of the wall thereof provided with openings which are brought into alignment with the openings in the receptacle to receive the blades of an electrical connector, so that, again, there is no other opening in the wall of the body for entry of dirt or other foreign matter, and the receptacle is covered, at all times, while the device is in use.

DETAILED DESCRIPTION OF THE INVENTION

Figures 1, 2, 3, 4, 5, 6:
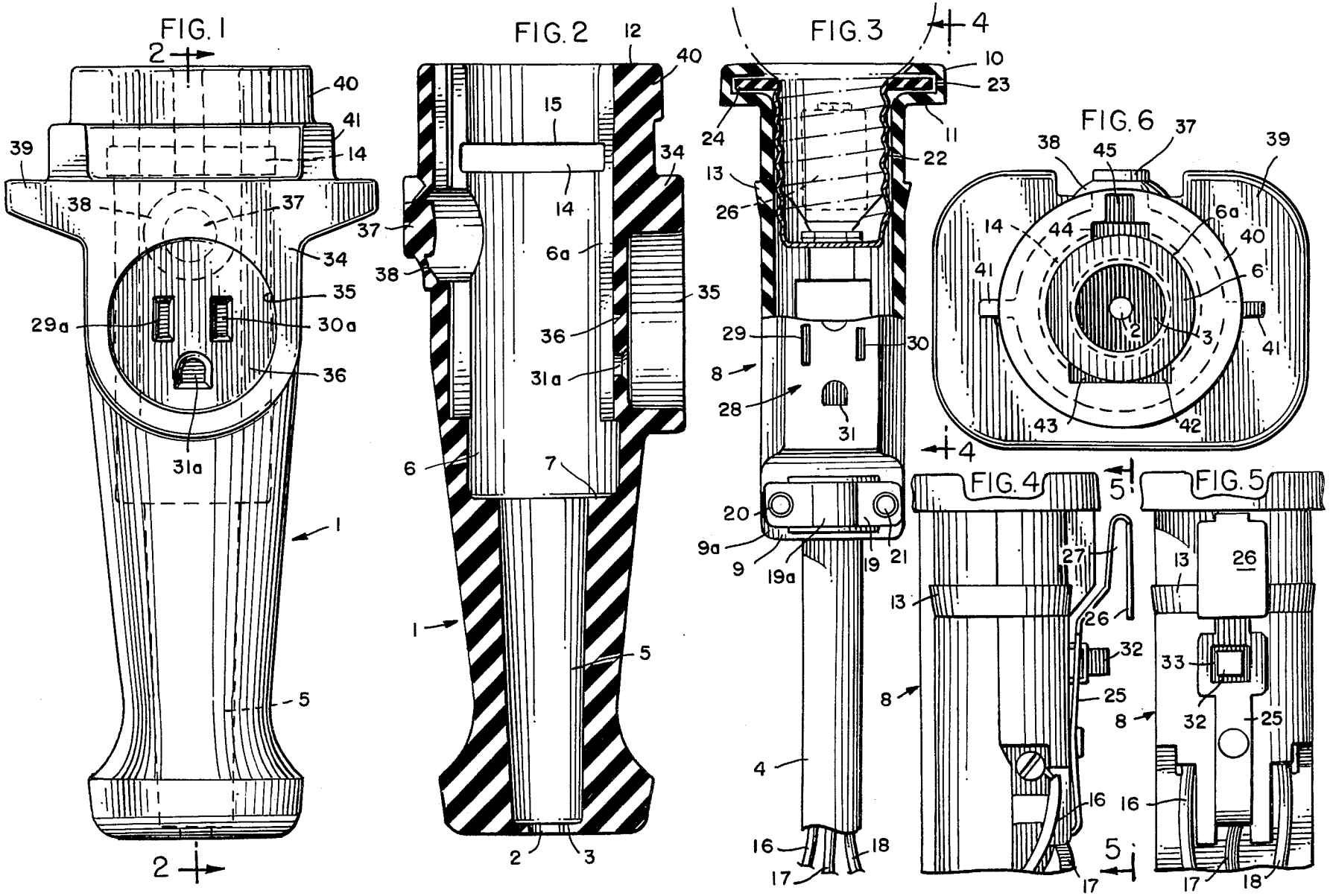
FIG. 1 is an elevational view of the one-piece molded handle embodying one form of the invention, wherein both a switch and a side outlet receptacle are provided.
FIG. 2 is a longitudinal, sectional view, taken substantially along the plane of line 2—2 of FIG. 1.
FIG. 3 is an elevational view, partly in section, of one form of a socket member, adapted to be inserted into and used with the handle of the type shown in FIGS. 1 and 2.
FIG. 4 is a fragmentary, elevational view of the socket member, taken along the plane of line 4—4 of FIG. 3.
FIG. 5 is a fragmentary, elevational view of the socket member, taken along the plane of line 5—5 of FIG. 4.
FIG. 6 is an end elevational view of the handle, looking in the direction of the arrows, and taken along the plane of line 6—6 of FIG. 7.

As mentioned heretofore, the handle and socket assembly to which the present invention is directed, may take any one of several specific forms. One form may include a switch for the light bulb, as well as an outlet receptacle in one side thereof, adapted to receive the male plug of a tool to be used in conjunction with the lamp itself. Another form may include the switch but no side outlet, while a third form may include the side outlet but no switch. The simplest form uses neither the switch nor the side outlet.

Referring now, more particularly, to the drawings, FIGS. 1 through 9 all illustrate, and are directed to the form of handle and socket assembly, provided with both a switch and a side outlet receptacle. In this form of the invention, the handle member, which is preferably formed of an impact-resistant elastomer, is generally indicated by the numeral 1. One end of the handle has an opening 2 therein, surrounded by a flexible, inwardly extending annular flange 3. An electric cord 4 is adapted to be inserted through the opening 2, and since the diameter of the cord 4 is preferably larger than the diameter of the opening 2, insertion thereof through the opening will cause the annular flange 3 to flex so that there will be a tight fit between the cord and the sides of the opening.

The handle is hollow, and is provided with an elongated bore 5, extending from the opening 2 inwardly, which communicates with the cavity 6 within the handle, thereby resulting in an annular shoulder 7.

The socket member is indicated, generally, by the numeral 8, and is adapted to be received within the cavity 6 in the handle. When it is positioned therein, the bottom 9 of the socket 8 will abut the shoulder 7.

The upper or outer end of the socket 8 is provided with the annular flange 10, having a shoulder 11 on the underside thereof which abuts against the outer end 12 of the handle when properly positioned therein.

Intermediate the ends of the socket member 8, there is provided a tapered area resulting in an annular shoulder 13, adapted to be received within the annular recess 14 on the inner wall of the cavity 6. When the socket is properly positioned therein, it is prevented from inadvertent removal because the shoulder 13 will abut against the upper or outer edge 15 of the annular recess 14.

Heretofore, when the handle was formed in two halves, rather than molded in one piece, it was necessary to place the socket in the cavity in one of the halves of the handle, and then wire the socket and connect the conductors within the cord to the proper terminals on the socket. The other half of the handle was then placed thereon, and secured thereto, and the handle was provided with a clamp, loosely mounted thereon to clamp the cord, so as to prevent undue strain on the conductors.

In the present invention, the socket may be wired and bussed and then the cord 4 will be inserted into the handle through the opening 2. The cord may be pulled through the handle to extend out of the other end thereof, whereupon the conductors 16, 17 and 18 may be attached to suitable terminals.

An additional and important feature of the present invention is the provision of means formed as a part of the socket for clamping the cord thereto, whereby the cord lamp will be rigid with the socket and positioned completely within the handle. The lower or inner end 9 of the socket 8 is provided with a relatively flat portion 9*a* with an arcuate recess therein (not shown) to receive one side of the cord 4. A clamp member 19, having an arcuate portion 19*a* in the center thereof is then placed over the other side of the cord 4, and secured in place by screws 20 and 21. This arrangement will securely clamp the cord 4 in place, and when the cord is pulled outwardly through the opening 2, the body of the socket member 8 will enter the cavity 6 within the handle for assembly purposes.

The outer end of the socket 8 is provided with a threaded member 22, inserted within the cavity 6, and is adapted to receive the threaded base of a light bulb. The annular flange 10 has an internal annular recess 23 therein around the threaded member to receive the flexible sealing ring 24, so that when a light bulb is screwed into the threaded member 22, it will flex the sealing ring 24, thereby to create a moisture-impervious and dust-proof seal.

The ground strip 24 is also secured to the socket member 8 and extends lengthwise of the socket along one side thereof. The inner end thereof is provided with a terminal to which the grounding conductor 17 may be secured. The upper or outer end of the ground strip is provided with a return bend 26, thereby creating a space 27, which receives the outer or upper end of the handle when the socket is assembled therewith. The return bend portion 26 provides a grounding point for external metal parts. This may be seen in phantom, for example, in FIGS. 7, 9A, 10A, 11A and 12A.

The outlet receptacle of the socket member is generally indicated by the numeral 28, and is provided with the openings 29 and 30, to receive the power blades of a plug, and the opening 31 to receive the ground blade thereof.

A switch button 32 is also provided in this form of the invention, and is preferably located on the opposite side of the socket member 8 from the outlet receptacle 28. Any suitable and well-known switching means can be provided within the socket for actuation by the switch button 32, which is preferably of the "push-push" type. The switch will turn the lamp on and off, since the tool connected to the side outlet will normally have its own operating switch. When the switch button 32 is provided, the ground strip 25 is formed with an opening 33 therein, through which the button 32 may extend.

The molded handle is formed so that a portion of the wall thereof is enlarged and made somewhat thicker than the other parts, as indicated by the numeral 34. This enlarged part of the wall is then recessed, as shown at 35, and the bottom of the recess 36 is a continuation of the inner part of the wall. This bottom 36 of the recess has openings therethrough which are brought into alignment with the openings in the side outlet of the socket to receive the power and ground blades of the male plug. The opening 29*a* is brought into alignment with the opening 29 in the socket, while the opening 30*a* is aligned with the opening 30 in the socket, and the opening 31*a* is aligned with the opening 31 in the socket.

In former constructions where an outlet receptacle was provided there would be one large opening through the wall of the handle, and the plug would be inserted directly into the openings of the socket member. This, however, permitted dirt, oil and grease to enter to the inside of the handle, and reach the socket, as well as the terminals therein. In the present construction the outlet receptacle of the socket is completely covered, at all times, except for the opening for the blades, and when the plug is inserted into the receptacle, there is no way by which dirt and the like could gain access into the interior of the handle.

A feature of the present invention, when a switch button is provided on the socket member, is the provision of a yieldable or resilient button in the wall of the handle, which can be pressed against the switch button to actuate the switch. This feature is more clearly brought out by reference to FIG. 2, where the flexible button is indicated by the numeral 37, and is supported by a relatively thin annular web 38. This web is molded as an integral part of the wall of the handle, and by supporting the button 37 by the thin annular web 38, it is normally held outwardly, as shown in FIG. 2, but may be pressed inwardly to actuate the switch button 32.

When the socket member is inserted into the handle, the switch button 32 will be positioned immediately behind the flexible button 37. Thus, the switch button is completely enclosed and can be actuated merely by pressing on the flexible button 37. Heretofore, in handle and socket assemblies of this type, the wall of the handle has been provided with an opening through which the switch button extends. Such opening permitted the entrance into the handle of dirt and other foreign substances, which, thereupon, made frequent cleaning or repairs necessary.

The body of the handle preferably is contoured in such a way as to provide the flange portions 39 extending outwardly from the opposite sides of the handle. The outer circular end of the handle has a neck portion 40, formed integral therewith, together with the opposed webs 41.

Referring to FIG. 6, it will be noted that the body of the socket member may be inserted through the large end of the handle, and when both the switch and outlet receptacle are provided for, the inner surface 6*a* of the cavity 6 is contoured so as to receive the socket and to prevent relative rotation between the socket and the handle.

The area of the outlet receptacle portion 28 on the socket member is flat, and, therefore, the inner surface of the cavity 6 has a cut-away portion 42, provided with the flat interior surface 43 to receive the flat surface portion of the socket.

On the opposite side of the handle, the surface of the cavity 6 is also cut-away, as at 44 and 45, to receive the switch button 32, and its mounting member therein.

In the assembly of these parts, the cord 4 is first inserted through the opening 2 into the handle, and will initially extend outwardly through the opposite end thereof where the conductors therein may be connected to the terminals of the socket, and clamped to the lower end thereof. The button 32 is then brought into alignment with the openings 44 and 45 on the one side, which will thereupon align the outlet receptacle 28 with the opening 42, at the opposite side. The socket may then be forced into the cavity in the handle. When assembled, the ground strip will have the return-bent portion 26 thereof extending outside of the handle. Cooperation of the annular shoulder 13 with the upper edge 15 of the annular recess 14 will prevent inadvertent removal of the socket from the handle. It will thus be evident that connection between the conductors and the socket may take place in an expeditious and simple manner outside of the handle, and the two parts quickly assembled. The construction is such that the socket, and the electrical connections thereof will be completely enclosed to prevent the entrance of foreign matter into the handle.

Figure 7:
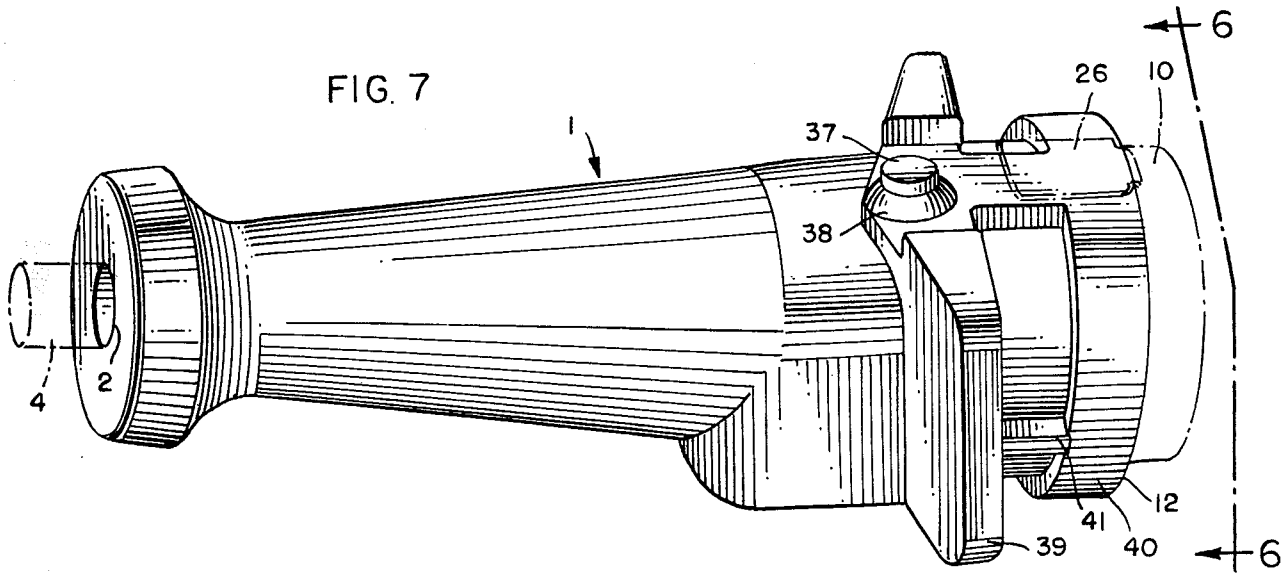
FIG. 7 is a perspective view of the handle of FIGS. 1 and 2, showing the flexible button for actuating the switch.
Figure 8:
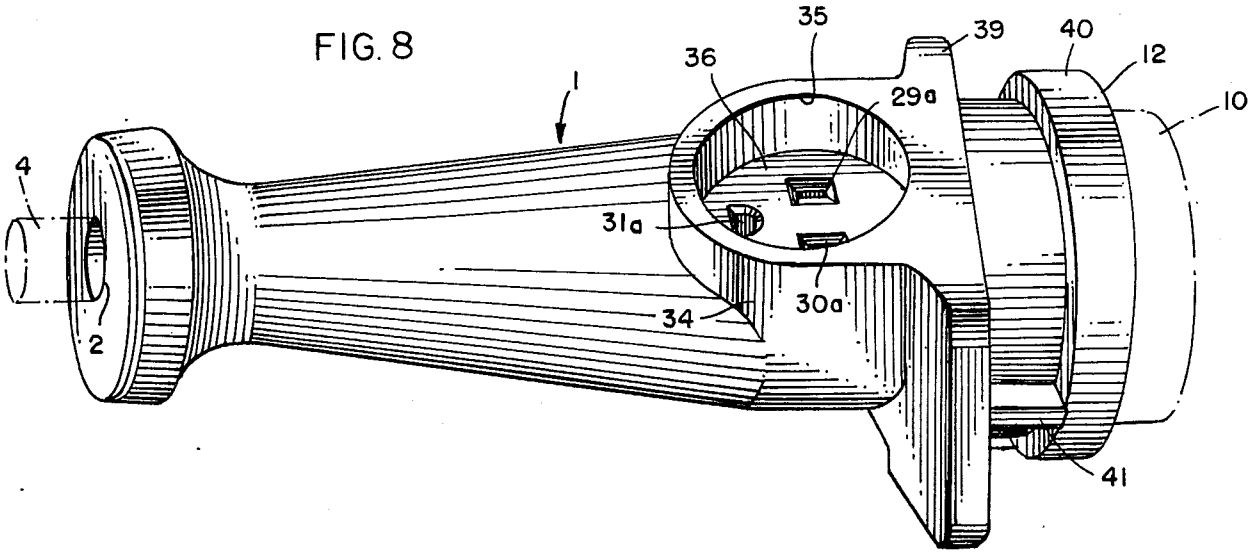
FIG. 8 is a perspective view of the handle shown in FIG. 7, but showing the opposite side thereof, illustrating the openings for the outlet receptacle of the socket.
Figures 9, 10, 11:
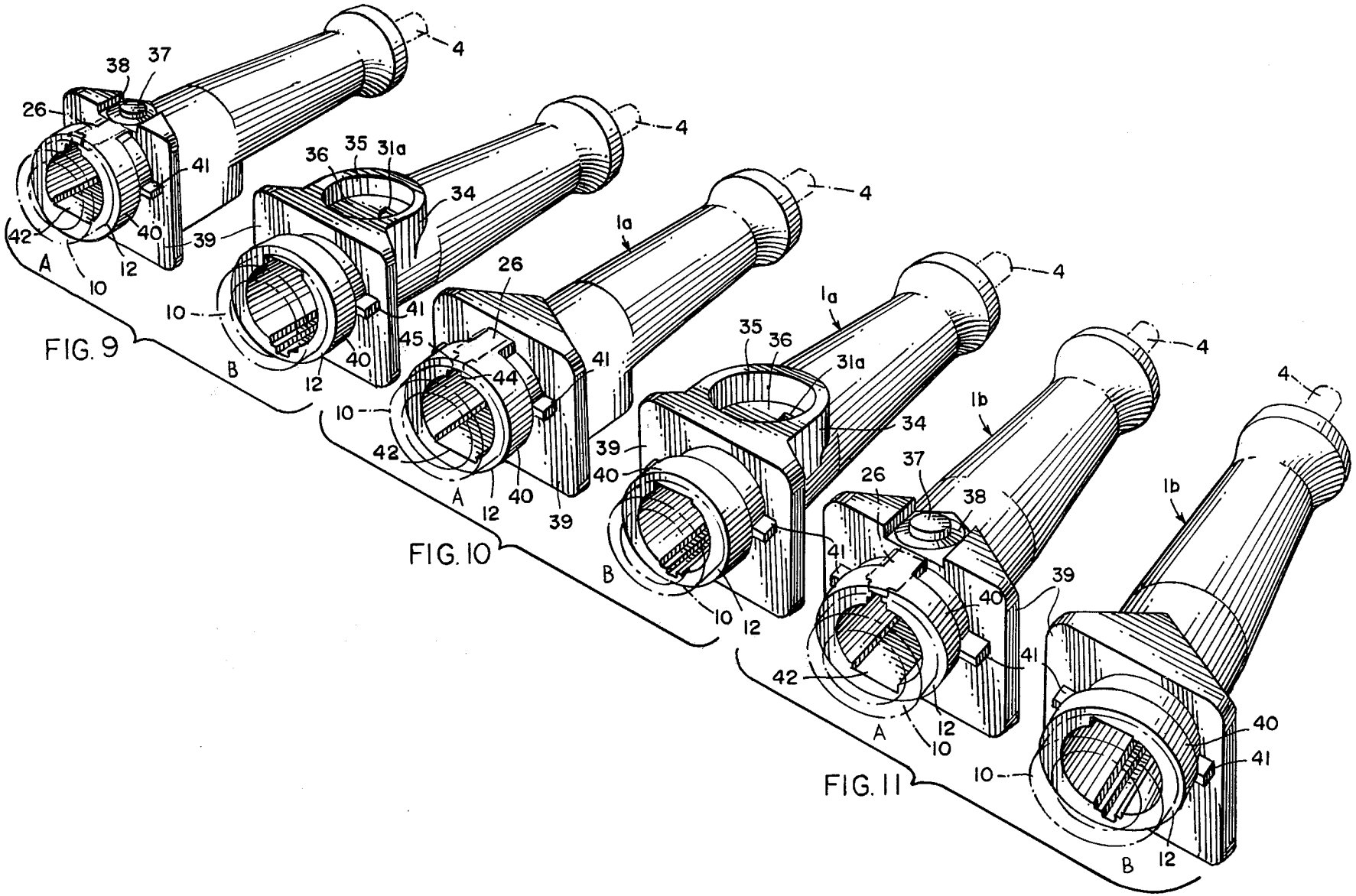
FIG. 9A is a perspective view of the handle, shown in FIGS. 7 and 8, but illustrating the opposite end thereof, and a portion of the socket in phantom.
FIG. 9B is a perspective view, similar to FIG. 9A, but showing the outlet receptacle side thereof.
FIGS. 10A and 10B are perspective views, similar to those of FIGS. 9A and 9B, but showing a modified form of the handle and socket assembly, wherein it is provided with a side outlet receptacle, but no switch.
FIGS. 11A and 11B are perspective views of a further modified form of handle and a socket assembly wherein a switch is provided, but no side outlet receptacle.
Figure 12:
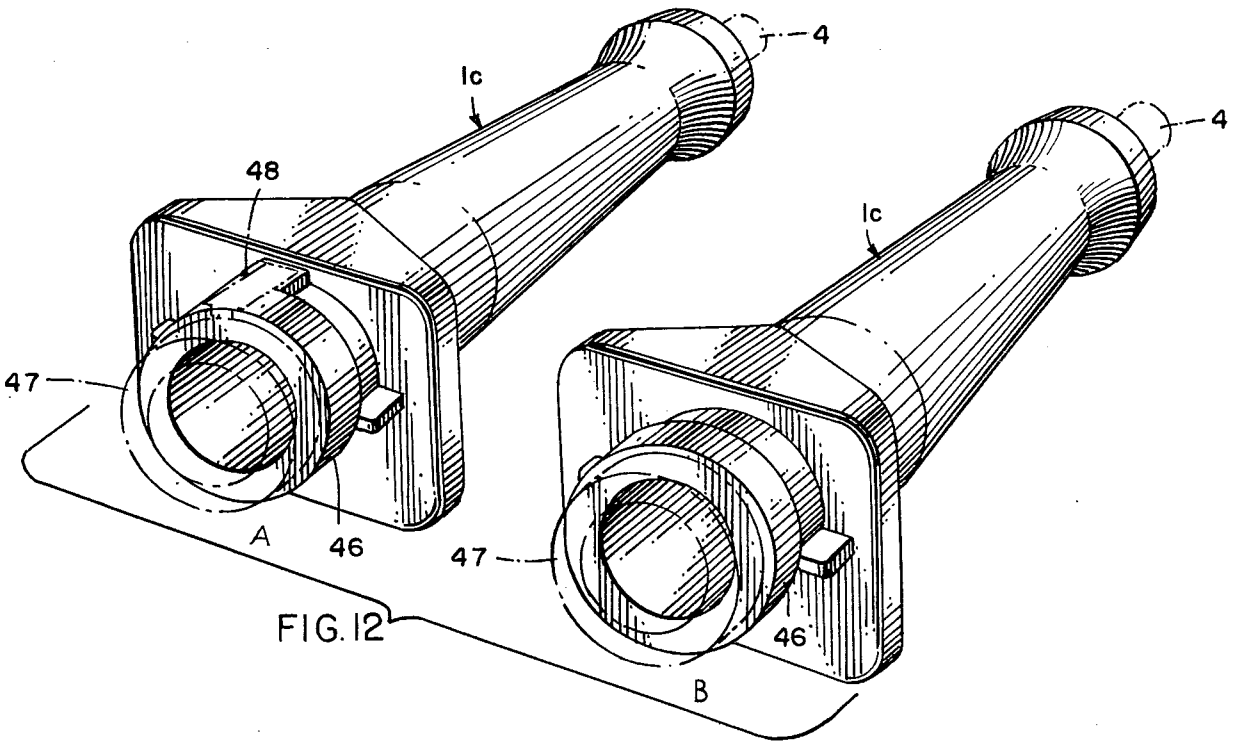
FIGS. 12A and 12B are perspective views of a further modified form of handle and socket assembly, wherein neither a switch or side outlet is provided.

FIGS. 9A and 9B illustrate in perspective the opposite ends of the handle from that shown in FIGS. 7 and 8, and show the end of the socket in phantom, protruding therefrom.

FIGS. 10A and 10B illustrate the form of the invention wherein the handle and the socket are provided with the outlet receptacle on the side thereof, but have eliminated the switch button. In these figures, the body of the handle is generally indicated by the numeral 1*a* but the other parts thereof are identified by the same numerals heretofore used with respect to the other figures. That is, the handle is provided with the same enlarged flange portions 39, neck 40, cut-away portions 42 44 and 45, and when assembled with the socket will have the portion 26 of the ground strip extending along one side of the neck. The recess 35 in the body of the handle is still provided with the bottom 36 of the recess 35, so that the outlet receptacle of the socket will be covered.

FIGS. 11A and 11B show the handle 1*b* which is provided with the flexible button 37 but has eliminated the side outlet receptacle.

FIGS. 12A and 12B illustrate the simplest form of the invention, wherein neither the switch button nor the side outlet is provided for. The handle in this instance is generally indicated by the numeral 1*c* but the neck 46 thereof need not be provided with any of the contoured recesses heretofore mentioned, since there is no switch button or side outlet with which to be concerned. The socket member 47, shown in phantom, will also have eliminated therefrom the switch button and side outlet, but it will still have the ground strip, and the return bent portion 48 thereof, which extends along the outer surface of the handle.

The invention also has the additional advantage that all four of the illustrated forms thereof may be made by having only four mold halves. For the form shown in FIG. 12, there will be two identical mold halves without any provision for the side outlet or switch button. Another mold half will have provision for the switch button, and the other mold half will have provision for the side outlet. Thus, these latter two mold halves may be used together to form a handle like that shown in FIGS. 1–9. The form shown in FIG. 10 may be made by using one plain mold half, and one having the side outlet. The form of FIG. 11 may be made with one plain mold half and one having the flexible button.

Thus, the manufacture of these various forms of the invention can be economical, as well as practical, and will provide an assembly which is vastly improved over similar assemblies known heretofore from the standpoint of simplicity, and ease of assembly.

Changes may be made in the form, construction and arrangement of parts from those disclosed herein without in any way departing from the spirit of the invention or sacrificing any of the attendant advantages thereof, provided, however, that such changes fall within the scope of the claims appended hereto.

I claim:

1. A hand lamp comprising, a. a one-piece, elongated body member formed of a molded, impact-resistant elastomer and having a cavity therethrough open at both ends.

b. a separate, unitary socket member received within said cavity, said socket member including 1. a threaded recess at one end thereof to receive a light bulb,
2. a two part cord clamp at the other end thereof adapted to receive and clamp thereon an electrical cord, one of the parts of said clamp being formed integral with said socket member,
3. terminals thereon, including a ground terminal to which electrical conductors in the cable may be connected, and
4. a ground strip connected at its inner end to said ground terminal and extending along the side of said socket member toward the end thereof having the threaded recess, and terminating in a return bend which receives the end of the wall of said body member when assembled therewith, c. said socket member being pre-bussed and prewired between said terminals and said threaded recess, and adapted to be assembled with said cord and conductors connected to said terminals outside of said body member and then inserted into said cavity through the other of the open ends thereof, and d. cooperating means in said cavity and on said socket member to retain said socket within said cavity.

2. A hand lamp, as defined in claim 1, combined with outlet receptacle means having openings therein in the side of said socket member, outlet openings in the wall of said body member corresponding to the openings in said receptacle means, the openings in said receptacle means being positioned in alignment with said openings in the wall of said body member, whereby the blades of an electrical connector, when inserted through said openings in the wall of said body member, will be received in the openings in said receptacle means, and a protective flange extending outwardly from the wall of said body member and surrounding said outlet openings.

3. A hand lamp, as defined in claim 1, combined with outlet receptacle means having openings therein in the side of said socket member, a recess in the wall of said body member and extending inwardly from the outer surface thereof, the bottom of said recess being formed by a relatively thin section of said wall, openings in the bottom of said recess corresponding to the openings in said receptacle means, said last named openings being positioned in alignment with said openings in the wall of said body member, whereby the blades of an electrical connector, when inserted through said openings in the wall of said body member, will be received in the openings in said receptacle means.

4. A hand lamp, as defined in claim 1, including a switch on said socket member operable to turn a light bulb on and off when actuated, and a flexible button formed integral with the wall of said body member, and covering said switch, and adapted to actuate said switch when depressed thereagainst.

5. A hand lamp comprising, a. a one-piece, elongated body member formed of a molded, impact-resistant elastomer and having a cavity therethrough open at both ends, b. a separate, unitary socket member received within said cavity, said socket member including 1. a threaded recess at one end thereof to receive a light bulb,
2. a cord clamp at the other end thereof and rigid therewith, adapted to receive and clamp thereon an electrical cord,
3. terminals thereon, including a ground terminal, to which electrical conductors in the cable may be connected, and
4. a ground strip connected at its inner end to said ground terminal and extending along the side of said socket member toward the end thereof having the threaded recess, and terminating in a return bend which receives the end of the wall of said body member when assembled therewith, c. said socket member being pre-bussed and prewired between said terminals and said threaded recess, and adapted to be assembled with said cord and conductors connected to said terminals outside of said body member and then inserted into said cavity through the other of the open ends thereof, d. cooperating means in said cavity and on said socket member to retain said socket within said cavity, e. a push type switch on said socket member extending through an opening in said ground strip and operable to turn a light bulb therein on and off when depressed, and f. a flexible button formed in the wall of said body member and adapted to actuate said switch when pressed inwardly thereagainst.

* * * * *